US010383176B2

(12) United States Patent
Goddard

(10) Patent No.: US 10,383,176 B2
(45) Date of Patent: Aug. 13, 2019

(54) HAIR LIGHTENING WAND

(71) Applicant: Henkel IP & Holding GmbH, Dusseldorf (DE)

(72) Inventor: Steven Goddard, Bell Canyon, CA (US)

(73) Assignee: HENKEL IP & HOLDING GmbH (DE)

( * ) Notice: Subject to any disclaimer, the term of this patent is extended or adjusted under 35 U.S.C. 154(b) by 121 days.

(21) Appl. No.: 15/233,911

(22) Filed: Aug. 10, 2016

(65) Prior Publication Data

US 2018/0049276 A1 Feb. 15, 2018

(51) Int. Cl.

| | |
|---|---|
| ***H05B 3/24*** | (2006.01) |
| ***A45D 2/00*** | (2006.01) |
| ***A45D 1/04*** | (2006.01) |
| *A45D 19/00* | (2006.01) |

(52) U.S. Cl.

CPC ..... *H05B 3/24* (2013.01); *A45D 1/04* (2013.01); *A45D 2/001* (2013.01); *A45D 19/0025* (2013.01); *A45D 2019/0091* (2013.01); *H05B 2203/03* (2013.01)

(58) Field of Classification Search

CPC ..... H05B 3/24; H05B 2203/03; H05B 3/44; H05B 1/0291; A45D 1/04; A45D 1/00; A45D 1/004; A45D 1/08; A45D 1/14; A45D 1/28; A45D 1/18; A45D 2/001; A45D 2/00; A45D 2/38; A45D 2/44; A45D 2/40; A45D 19/0025; A45D 2019/0091; A45D 2001/008

See application file for complete search history.

(56) References Cited

U.S. PATENT DOCUMENTS

| | | | | |
|---|---|---|---|---|
| 6,191,387 | B1 | 2/2001 | Smal | |
| 6,386,206 | B2 | 5/2002 | Lee | |
| 8,013,275 | B2 | 9/2011 | Ng et al. | |
| 8,230,868 | B2 * | 7/2012 | Choi | A45D 1/04 132/224 |
| 8,544,477 | B1 | 10/2013 | Laaly | |
| 2001/0013513 | A1 | 8/2001 | Chan | |
| 2005/0016557 | A1 | 1/2005 | Fasan | |
| 2006/0196523 | A1 | 9/2006 | Choi | |
| 2013/0192625 | A1 | 8/2013 | Migliori et al. | |

* cited by examiner

*Primary Examiner* — Shawntina T Fuqua
(74) *Attorney, Agent, or Firm* — Christopher R. Balzan, Esq.

(57) ABSTRACT

In one embodiment, a hair lightening wand is provided, which includes an upper arm and lower arms having upper and lower heating plates, respectively. The arms are pivotally connected by a hinge. The upper and lower heating plates are separated by a gap of a fixed distance along an entire length of the upper and lower heating plates when the upper and lower arms are in a fully closed position. The gap between the upper and lower heating plates is unobstructed in a direction transverse to the upper and lower arms along a length of the upper and lower heating plates.

21 Claims, 6 Drawing Sheets

HAIR LIGHTENING WAND

BACKGROUND

Changing hair color is a popular way to change one's appearance. Many opt for a lighter hair color. This is accomplished with various hair lightening techniques, utilizing various traditional tools and processes. The process is sometimes repeated, even in the same sitting, to achieve a desired tone. To change appearance again, the process must be repeated. To maintain a desired look, the process is repeated periodically. Traditional hair lightening, however, damages hair with virtually every application. As a result, the look and feel of the hair is noticeably degraded with traditional hair lightening techniques.

The damage that results from even a single application can influence many to refrain from hair lightening all together, to prevent damage to their hair. With those that do choose to lighten, actual hair damage, or the potential to damage hair, limits the level and/or frequency of hair lightening that can be realized. As such, due to the damaging effects of traditional techniques, exposure to the lightening process must be limited in duration and frequency, which may not produce the desired results for an individual. Even when individuals are fully satisfied with the hue of their hair, many must tolerate an unacceptable degree of damage to their hair.

What is needed is a way to achieve a desired hair color while minimizing damage to the hair.

SUMMARY

In one embodiment, a hair lightening wand is provided, which includes an upper arm and lower arms having upper and lower heating plates, respectively. The arms are pivotally connected by a hinge. The upper and lower heating plates are separated by a gap of a fixed distance along an entire length of the upper and lower heating plates when the upper and lower arms are in a fully closed position. The gap between the upper and lower heating plates is unobstructed in a direction transverse to the upper and lower arms along a length of the upper and lower heating plates.

In various embodiments, a heating plate spacer may be provided located between the upper and lower arms. The heating plate spacer may be located between the hinge and the upper and lower heating plates.

The upper and lower arms may form a handle between the hinge and the upper and lower heating plates. In various embodiments the heating plate spacer is located in the handle.

In various embodiments, the heating plate spacer and the upper and lower arms are constructed such that heating plate spacer limits the minimum distance between the upper and lower heating plates to provide a gap that hair may pass through without contacting the upper or lower heating plates.

In one embodiment, a hair lightening wand is provided that has an upper arm and a lower arm pivotally connected at a handle end. The upper arm includes an upper heating plate and the lower arm includes a lower heating plate at a head end. A spacer is provided between the upper arm and the lower arm to limit a minimum distance between the upper and lower arms at the head end so as to provide a gap at the minimum distance between the upper and lower arms at the head end. The upper and lower arms are constructed such that the upper and lower arms are substantially parallel at the head end and the gap is unobstructed across the head in a direction transverse to the upper and lower arms along a length of the upper and lower arms in the head end.

In various embodiments, the spacer and the upper and lower arms are constructed such that spacer limits the minimum distance between the upper and lower heating plates to provide a gap that hair may pass through without contacting the upper or lower heating plates.

In yet other further embodiments, the spacer and the upper and lower arms are constructed such that spacer between the upper arm and the lower arm limit a minimum distance between the upper and lower arms at the handle end to provide a gap between the upper and lower arms at the handle end surrounding the spacer.

In some embodiments the spacer is located in an interior portion of the handle end spaced away from lateral edges of the handle.

DESCRIPTION

With conventional techniques, a lightener is placed on the hair and a traditional flat iron is used to apply heat to activate, or to speed up the lighten process. With such techniques, typically the flat iron comes into contact with the hair to apply heat to the lightener, and the hair, by conduction. Unfortunately, both the chemical lightener and the application of heat directly to the hair and lightener causes damage to the hair.

Figure 1:
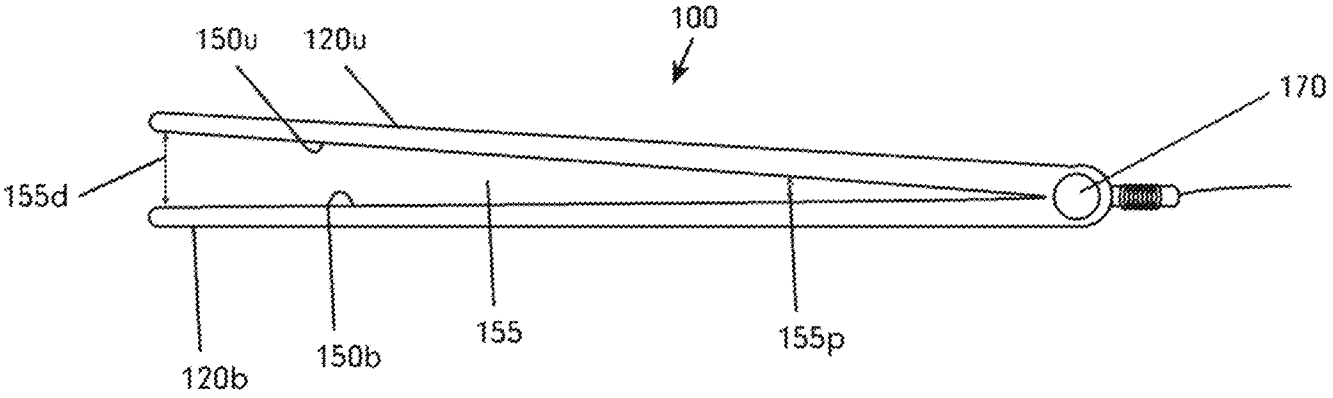
FIG. 1 (Prior Art)
FIG. 1 shows a simplified side view of a prior art flat iron for hair.

FIG. 1 shows a simplified side view of a traditional flat iron 100 for hair, which is used for conventional hair lightening processes. The upper and lower arms 120*u* and 120*b* are connected together by a hinge 170. Upper and lower heating plates 150*u* and 150*b* are secured to the upper and lower arms 120*u* and 120*b*, respectively, opposing each other across a gap 155. With this traditional design, the width of the gap 155 varies along the length of the arms 120*u* and 120*b*. The gap 155 between the heating plates 150*u* and 150*b* can have a 50 percent, or more, greater distance distal from the hinge 170 than close to the hinge 170. As a result, during a lightening process, the hair (not shown) is not heated evenly along the length of the arms 120.

As the gap 150 is reduce during a lightening process, more heat is applied to the hair closer to the hinge 170 and less heat farther away because the heating plates 150 are closer, near the hinge 170, and farther apart distal from the hinge 170. Before contacting the hair, the varied distance between 155*d* and 155*p* causes uneven convectional heating of the hair. Even when the gap 150 is reduce so that the arms 120*u* and 120*b* come in contact with hair, the pressure against the hair can be greater near the hinge 170, where the spring (not shown) is typically located, and less further away from the hinge 170. As a result, the conductional heating of the hair is uneven, greater near the hinge 170 and less distal from the hinge 170. Thus, with this type of flat iron 100, during a lightening process, the temperature of the hair between the arms 120 can significantly vary along the length of the arms 120. If the heat is not evenly applied to the hair during a hair lightening process, the results can suffer.

Moreover, since the heating plates of a conventional flat iron come into direct contact with the hair, the conventional flat iron can significantly overheat the hair, thereby causing damage to the hair.

Figure 2:
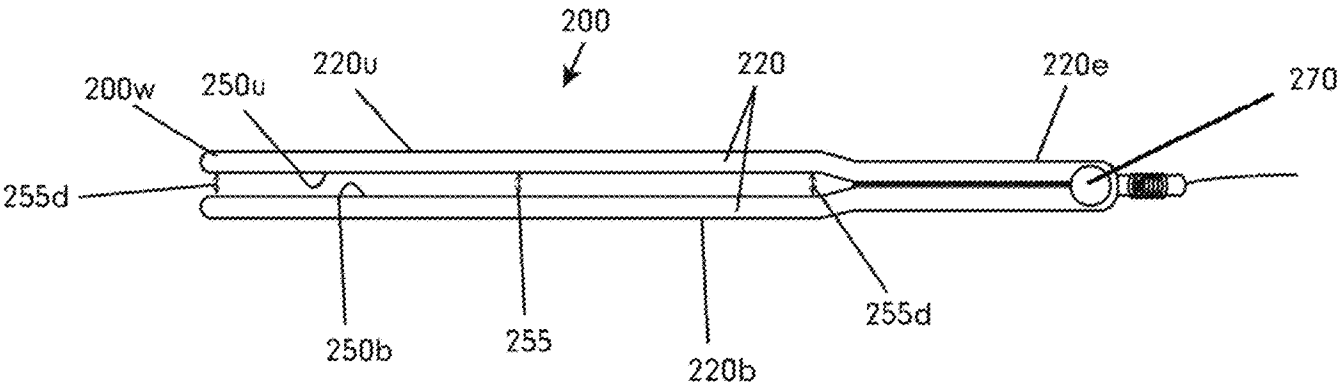
FIG. 2 shows a simplified side view of one embodiment of the present invention.

Turning to FIG. 2, shown is a simplified side view of one embodiment of the present invention. In this embodiment, a hair lightening wand 200 is provided where the arms 220 are separated by a gap 255 at the head end 200*w* of the hair lightening wand 200. Upper and lower heating plates 250*u* and 250*b* are mounted with the upper and lower arms 220*u* and 220*b*, respectively, to oppose each other across the gap 255. In this embodiment, the upper and lower arms 220*u* and 220*b* are substantially parallel and separated by a minimum distance along a length of the gap 255 where the upper and lower heat plates 250*u* and 250*b* are located, when the arms 220 are fully closed.

When the arms 220 fully closed, the upper and lower arms 220*u* and 220*b* contact each other near the handle end 200*e*, between gap 255 and the hinge 270, to define the minimum distance of separation of the arms 220 at the head end 200*w*. Thus, since the upper and lower heating plates 250*u* and 250*b* are mounted to the upper and lower arms 220*u* and 220*b*, this contact also defines a minimum distance that the upper and lower heating plates 250*u* and 250*b* are separated when the wand 220 is fully closed as shown in FIG. 2.

In some implementations, when the hair lightening wand 200 is in use, the gap 255 allows hair (not shown in FIG. 2) to pass unobstructed between the arms 220 with heating plates 250*u* or 250*b*. The gap 255 is unobstructed along its length and across the width of the wand 200. Furthermore, in some embodiments the minimum distance of the gap 255 is selected to allow hair to pass unrestricted and untouched through the arms 220, and unrestricted and without directly contacting the upper or lower heating plates 250*u* or 250*b*.

In some embodiments, the distance of the gap 255 is selected to allow hair with lightener applied and covered with foils (shown in FIG. 5) to pass through the minimum gap 255 of the wand 200. Maintaining a fixed gap 255 size, constant across the length and width of the gap 255 allows a more controlled application of heat to the hair. This improves hair lightening results. Furthermore, it allows for a faster lightening process because a more even temperature is applied across the length of the wand 200. Additionally, because the heat is applied more evenly and more predictably, the temperature of the heating plates 250 can be lowered to improve the condition of the hair after a treatment.

Figure 3A:
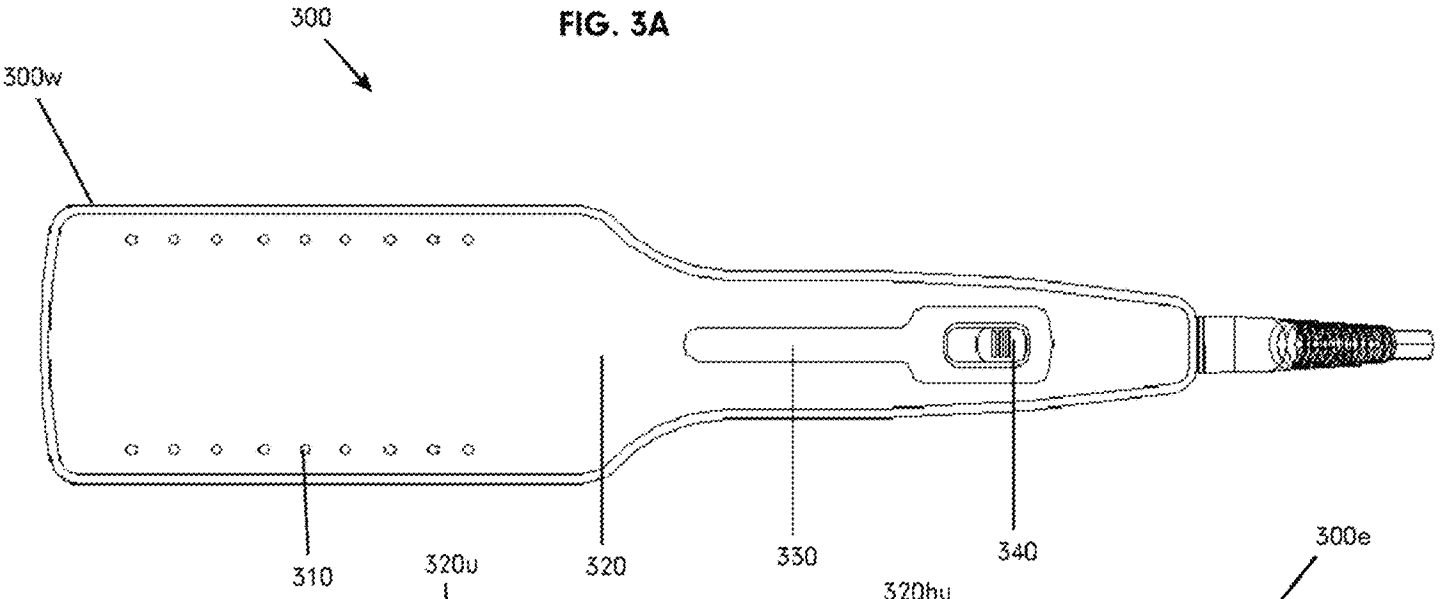
FIG. 3A shows a top view of a possible embodiment of the hair lightening wand.
Figure 3B:
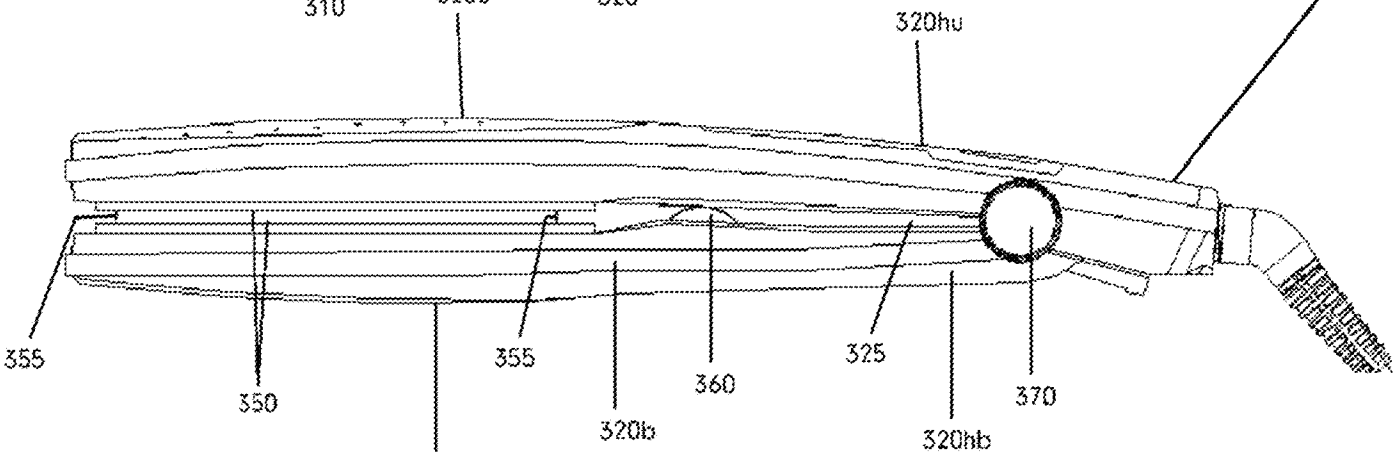
FIG. 3B shows a side view of the hair lightening wand corresponding to the embodiment of FIG. 3A.

FIG. 3A shows a top view of a possible embodiment of the hair lightening wand 300 and FIG. 3B shows a side view of the hair lightening wand 300 corresponding to the embodiment of FIG. 3A. In this embodiment, a heating plate spacer 360 is used to define the minimum distance between the upper and the lower arms 320*u* and 320*b*, and thus the minimum distance between the heating plates 350, mounted therewith, to define the working gap 355 located between the heating plates 350. In one presently preferred embodiment, the working gap 355 is about 3 millimeters. In other embodiments, the working gap 355 can be selected to be in a range from about ⅛ inch to about 3/16 inch. In other embodiments, the working gap may be selected to be in a range from about 1/16 inch to about ¼ inch.

In the embodiment of FIGS. 3A and 3B, the heating plate spacer 360 is in the handle end 300*e* of the wand 300, between the hinge 370 and the gap 355. In this embodiment, the heating plate spacer 360 is an arcuate protrusion or bump from the lower arm 320*b*, which contacts an opposing surface of the upper arm 320*u*. The heating plate spacer 360 is received by a downward facing receiver portion of the upper arm 320*u*. The heating plate spacer receiver portion may be a depression or "cut-out" in the upper arm 320*u* (shown in FIG. 4 as 465).

A switch 340 is used to turn power on to the wand 300 and a visual indicator 330, such as a light emitting diode(s), can be included to provide the status of the wand 300, for example, on/off, heating plate temperature, etc.

The handle portions 320*hu* and 320*hb* are narrower in width than the head end 300*w* for ease of handling by the stylist, colorist, or other user. For further ease of handling, in this embodiment, not only does the heating plate spacer 360 define a fixed minimum distance for the working gap 355 where the hair is placed, it also defines a gap between the handle portions 320*hu* and 320*hb* of the upper and lower arms 320*u* and 320*e*. The gap between the upper and lower handle portions 320*hu* and 320*hb* of the upper and lower arms 320*u* and 320*b* reduces occurrences and/or severity of any hand pinching to the stylist/colorist or other user, which otherwise might occur between the upper and lower handle portions 320*hu* and 320*hb* when the wand 300 is closed.

As shown in FIG. 3A, vent holes 310 are provided in the head end 300*w* to help keep the temperature of the heating plates lower to further contribute to reducing heat damage to the hair, thereby improving the condition of the hair after treatment.

Figure 4:
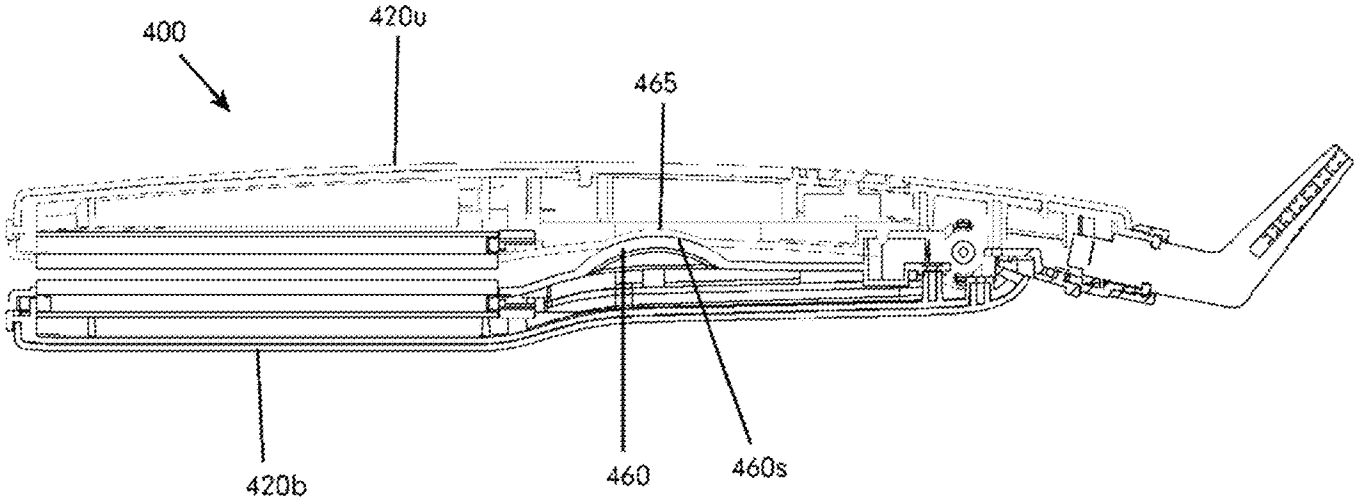
FIG. 4 shows a cut away side view of an embodiment of the hair lightening wand.

FIG. 4 shows a cut away side view of an embodiment of the hair lightening wand 400. Shown in FIG. 4 is the heating plate spacer 460 protruding as an arcuate shaped protrusion from the lower arm 420*b*, which has a surface 460*s* that touches the heating plate spacer receiver 465, an arcuate shaped receiver 465 formed in the upper arm 420*u*.

Figure 5:
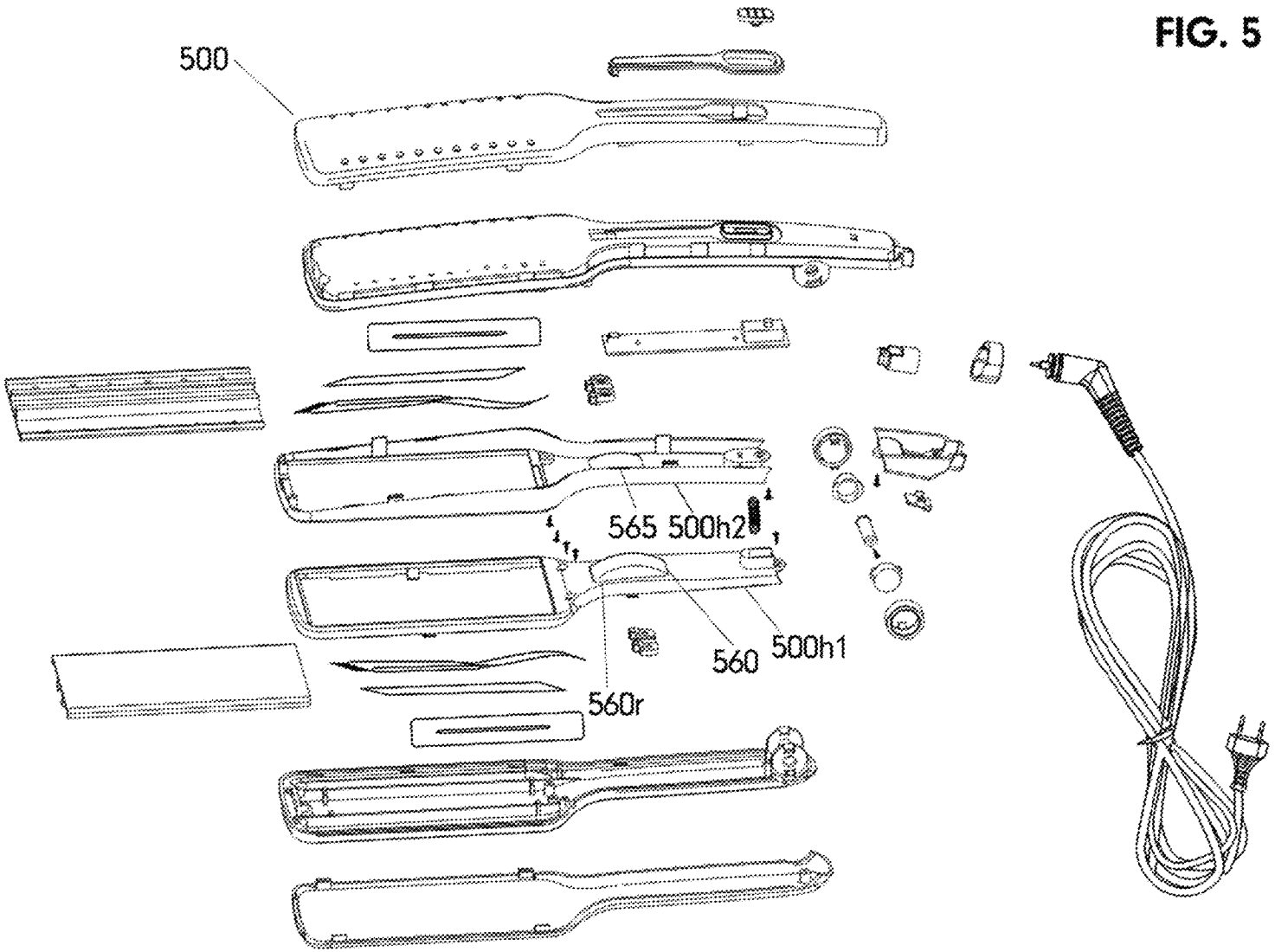
FIG. 5 shows an exploded view of an embodiment of the hair lightening wand.

FIG. 5 shows an exploded view of an embodiment of the hair lightening wand 500. Shown in FIG. 5 is the heating plate spacer 560 protruding from the lower handle portion 500$h_2$ as an arc shaped slice configuration. A corresponding arc shaped depression or recess 565 in the upper handle portion 500$h_2$ forms the heating plate spacer receiver 565. The optional recess 565 helps to keep the upper and lower arms aligned when closed.

In addition, the heating plate spacer 560 is set back from the lateral or side edges of the handle. That is, the heating plate spacer 560 does not extend laterally all the way to the edge of the handle. Instead, there is a space 560*r* between edge of the handle and the heating plate spacer 560. This helps prevent the stylist, colorist, or other user from pinching their hand in the handle with the heating plate spacer 560 when closing the wand 500 over hair during a treatment.

Figure 6:
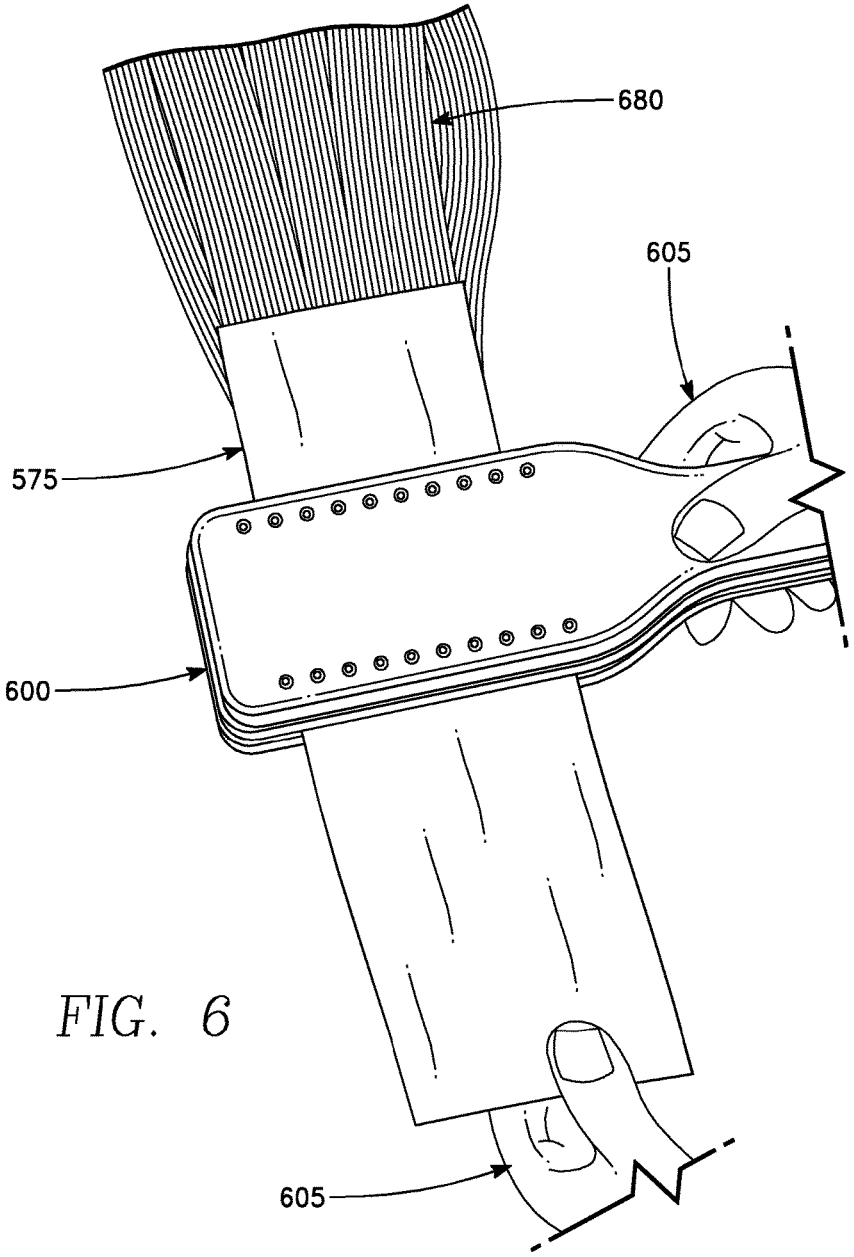
FIG. 6 is an illustration showing a possible implementation using a hair lightening wand 600.

FIG. 6 is an illustration showing a possible implementation using a hair lightening wand 600. With this implementation, a foil 675 is placed over and under the hair 580, which has hair lightener applied. Any hair lightener may be applied, however, PURE LIGHT CREAME LIGHTENER, available from Pravana Co., 20750 Ventura Boulevard, Suite 155, Woodland Hills, Calif. 91364, www.pravana.com, is presently preferred. The hair lightening wand 600 is brought into slidable contact with the foil 675 and slid along the foil 675 to apply a uniform heat over and under the hair 680 covered by the foil 675, while the stylist or user 605 holds the foil 675 in place.

Figure 7:
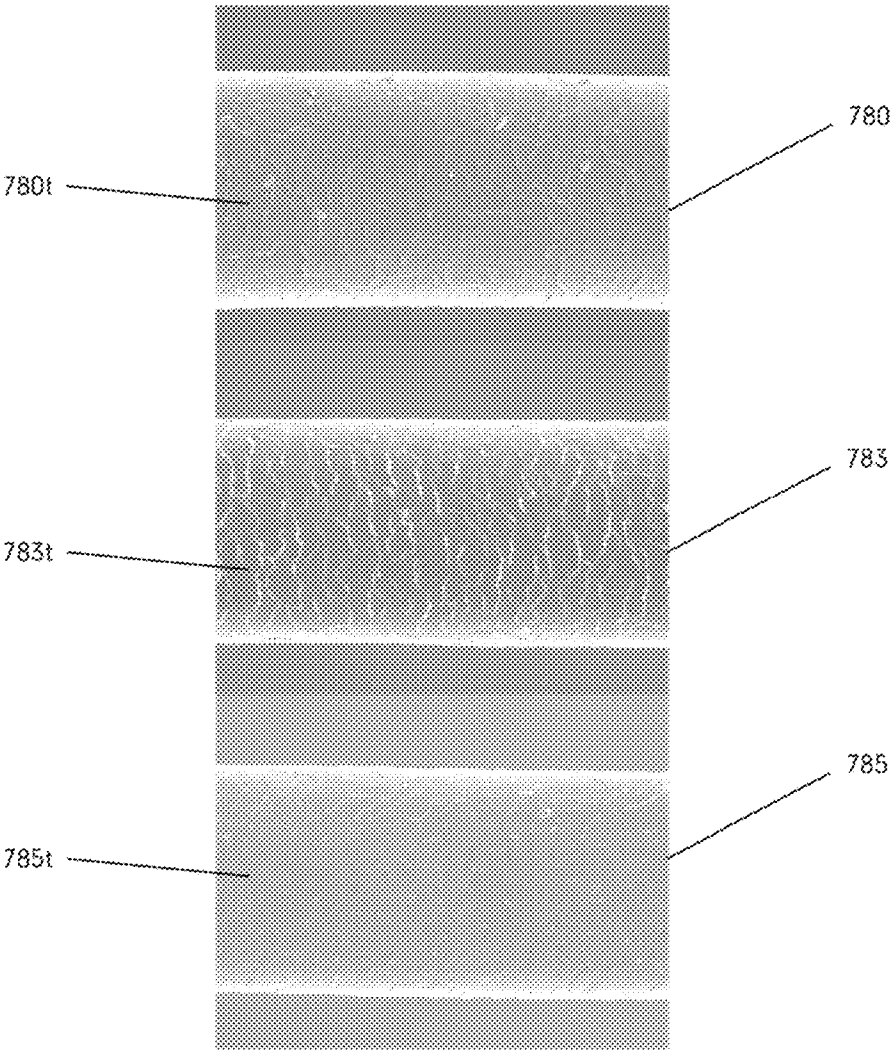
FIG. 7 shows depictions of side view portions of strands of hair as seen under an electron microscope.

Turning to FIG. 7, shown are depictions of side view portions of strands of hair as seen under an electron microscope. The strand 780 is a depiction of an enlarged portion of strand of virgin hair before hair treatment. The strand 783 is a depiction of an enlarged portion of a strand of hair after a traditional lightening application, processed 40 minutes with traditional powder lightener, having +20 Vol. The strand 785 is a depiction of a portion of hair which has been processed with the hair lightening wand of the present invention for 10 seconds with PURE LIGHT CREAME LIGHTENER, having +20 Vol. The strand 785 is in better condition than the strand 783, which was treated with a traditional lightening application. As is evident, the texture 785*t* of the hair 785 treated with the hair lightening wand of the present invention appears much closer in surface texture to the texture 780*t* of the untreated hair 780 than does the texture 783*t* of hair 783 treated with a traditional process. The hair 785 appears smoother and healthier than the hair 783.

Various embodiments and implementations of the present invention provide improved results over conventional processes using traditional hair lightening irons. The uniform fixed minimum working gap of the wand, along with heat range coupled with the ingredients of the lightener and the fact that this device allows for the bleach to work so much quicker leads to less damage than the traditional process.

This unique thermal processing tool allows colorists the ability to fully process foil highlights, lifting 5 levels in 10 seconds and with less damage to the hair than a comparable lightener processed at room temperature for 40 minutes. This allows a colorist to offer clients a complete highlighting service in about half the time, while leaving the hair in better condition than with prior treatment methods. As such, there is no need for expensive lightening additives.

Moreover, the design of various embodiments of the lightening wand allows lightening formula creep, swell, and puff to be reduced, in part due to the lower applied temperatures and pressures possible with various embodiments of the lightening wand. With various implementations and embodiments, a lower heat can be applied, for example in a range of between about 285 degrees and about 300 degrees Fahrenheit, to more slowly heat the hair to reduce damage to the hair, while providing the desired lightening results in less time.

It is worthy to note that any reference to "one embodiment" or "an embodiment" means that a particular feature, structure, or characteristic described in connection with the embodiment may be included in an embodiment, if desired. The appearances of the phrase "in one embodiment" or "in an embodiment" in various places in the specification are not necessarily all referring to the same embodiment.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated.

Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

Having described this invention in connection with a number of embodiments, modification will now certainly suggest itself to those skilled in the art. The example embodiments herein are not intended to be limiting, various configurations and combinations of features are possible. As such, the invention is not limited to the disclosed embodiments, except as required by the appended claims.

What I claim is:

1. A hair lightening wand comprising:

a) an upper arm comprising an upper heating plate;

b) a lower arm comprising a lower heating plate;

c) a hinge pivotally connecting the upper arm and the lower arm;

d) wherein the upper and lower heating plates are separated by a gap of a fixed distance along an entire length of the upper and lower heating plates when the upper and lower arms are in a fully closed position; and e) wherein the gap between the upper and lower heating plates extends all the way through the upper and lower arms and is unobstructed in a direction transverse to the upper and lower arms along a length of the upper and lower heating plates so as to allow hair to pass through unrestricted and untouched through the upper and lower arms when the upper and lower arm are in the fully closed position.

2. The wand of claim 1 further comprising a heating plate spacer located between the upper and lower arms.

3. The wand of claim 2, wherein the heating plate spacer is located between the hinge and the upper and lower heating plates.

4. The wand of claim 3, wherein the upper and lower arms further comprise a handle between the hinge and the upper and lower heating plates.

5. The wand of claim 4, wherein the heating plate spacer is located in the handle.

6. The wand of claim 2, wherein the upper and lower arms further comprise a handle between the hinge and the upper and lower heating plates.

7. The wand of claim 6, wherein the heating plate spacer is located in the handle.

8. The wand of claim 2 further comprising a heating plate spacer receiver opposing the heating plate spacer and configured to receive the spacer therewithin.

9. The wand of claim 2, wherein at least one of the upper or lower arms further comprises vent holes adjacent a respective one of the at least one upper or lower arms.

10. The wand of claim 2, wherein the heating plate spacer is located between the hinge and the upper and lower heating plates.

11. The wand of claim 10, wherein the hinge is located distal from the upper and lower heating plates.

12. The wand of claim 1, wherein the heating plate spacer and the upper and lower arms are constructed such that the heating plate spacer limits the minimum distance between the upper and lower heating plates to provide a gap that hair may pass through without contacting the upper or lower heating plates.

13. A hair lightening wand comprising:

a) an upper arm and a lower arm pivotally connected at a handle end;

b) the upper arm comprising an upper heating plate and the lower arm comprising a lower heating plate at a head end;

c) a spacer between the upper arm and the lower arm to limit a minimum distance between the upper and lower arms so as to provide a gap at the minimum distance between the upper and lower arms at the head end;

d) wherein the upper and lower arms are constructed such that the upper and lower arms are substantially parallel at the head end;

e) wherein the gap is unobstructed across the head in a direction transverse to the upper and lower arms along a length of the upper and lower arms in the head end; and f) wherein the gap extends all the way through the upper and lower arms so as to allow hair to pass unrestricted and untouched through the upper and lower arms and without being pressed against the upper or lower heating plates when the upper and lower arms are in a fully closed position.

14. The wand of claim 13, wherein the spacer and the upper and lower arms are constructed such that spacer limits the minimum distance between the upper and lower heating plates to provide a gap that hair may pass through without contacting the upper or lower heating plates.

15. The wand of claim 13, wherein the spacer and the upper and lower arms are constructed such that the spacer between the upper arm and the lower arm limit a minimum distance between the upper and lower arms at the handle end to provide a gap between the upper and lower arms at the handle end surrounding the spacer.

16. The wand of claim 15 wherein the spacer is located in an interior portion of the handle end spaced away from lateral edges of the handle.

17. The wand of claim 13 further comprising a handle at the handle end, and wherein the spacer is located in an interior portion of the handle end spaced away from lateral edges of the handle.

18. The wand of claim 13, wherein the heating plate spacer is located between the hinge and the upper and lower heating plates.

19. The wand of claim 13 further comprising a spacer receiver opposing the spacer and configured to receive the spacer therewithin.

20. A hair lightening wand comprising:

a) an upper arm and a lower arm pivotally connected with a hinge at a handle end;

b) the upper arm comprising an upper heating plate and the lower arm comprising a lower heating plate at a head end;

c) a spacer between the upper arm and the lower arm to limit a minimum distance between the upper and lower heating plates so as to provide a working gap at the minimum distance between the upper and lower heating plates at the head end, the spacer being located between the hinge and the upper and lower heating plates;

d) a spacer receiver opposing the spacer and configured to receive the spacer therewithin;

e) a handle at the handle end, the spacer and the receiver being located in an interior portion of the handle end spaced away from lateral edges of the handle;

f) wherein upper and lower arms are constructed such that the spacer between the upper arm and the lower arm limit a minimum distance between the upper arm and the lower arm between the handle to provide a handle gap between the upper and lower arms at the handle end surrounding the spacer;

g) wherein the upper and lower arms are constructed such that the upper and lower heating plates are held substantially parallel across area working gap at the head end when the upper and lower arms are closed; and h) wherein the spacer and the upper and lower arms are constructed such that the spacer limits the minimum distance between the upper and lower heating plates such that the working gap passes all the way through the upper and lower arms so as to allow hair to pass through without being contacted when the upper and lower arms are in a fully closed position.

21. The wand of claim 20, wherein the working gap is unobstructed across the head in a direction transverse to the upper and lower arms along a length of the upper and lower arms in the head end.

* * * * *